US005447420A

United States Patent [19]

Caillat et al.

[11] Patent Number: 5,447,420

[45] Date of Patent: * Sep. 5, 1995

[54] SCROLL COMPRESSOR WITH LIQUID INJECTION

[75] Inventors: Jean-Luc Caillat, Dayton; Karl P. Wang, Vandalia, both of Ohio

[73] Assignee: Copeland Corporation, Sidney, Ohio

[ * ] Notice: The portion of the term of this patent subsequent to Jul. 19, 2011 has been disclaimed.

[21] Appl. No.: 228,863

[22] Filed: Apr. 13, 1994

Related U.S. Application Data

[63] Continuation of Ser. No. 912,908, Jul. 13, 1992, Pat. No. 5,329,788.

[51] Int. Cl.[6] ..... F04C 18/04; F04C 29/04

[52] U.S. Cl. ..... 418/55.5; 418/55.6; 418/57; 418/97; 418/99

[58] Field of Search ..... 418/55.6, 97, 99, 55.5, 418/57

[56] References Cited

U.S. PATENT DOCUMENTS 5,329,788 7/1994 Caillat et al. ..... 418/55.6

FOREIGN PATENT DOCUMENTS 58-170873 10/1983 Japan ..... 418/99
63-131887 6/1988 Japan ..... 418/55.6
3145589 6/1991 Japan ..... 418/55.6

*Primary Examiner*—John J. Vrablik
*Attorney, Agent, or Firm*—Harness, Dickey & Pierce

[57] ABSTRACT

A scroll-type refrigerant compressor for use in a conventional refrigerating circuit and having liquid refrigerant compressor cooling provided by the injection of liquid refrigerant into an intermediate biasing chamber and/or specifically located bleed holes.

14 Claims, 6 Drawing Sheets

SCROLL COMPRESSOR WITH LIQUID INJECTION

This is a continuation of U.S. patent application Ser. No. 07/912,908, filed Jul. 13, 1992, U.S. Pat. No. 5,329,788.

BACKGROUND AND SUMMARY OF THE INVENTION

This invention relates generally to scroll type compressors and more specifically to a scroll type compressor having provision for the injection of liquid refrigerant at an intermediate stage of the compression cycle to thereby reduce overheating.

Scroll compressors are known to be extremely efficient, reliable and quiet in applications for the compression of refrigerant. However, like all compressors, they are subject to overheating during certain high load situations.

In the normal refrigeration cycle, vapor is drawn into a compressor where it is compressed to a higher pressure. The compressed vapor is cooled and condensed in a 15 condenser into a high pressure liquid which is then expanded, typically through an expansion valve, to a lower pressure and caused to evaporate in an evaporator to thereby draw in heat and thus provide the desired cooling effect. The expanded, relatively low pressure vapor exiting the evaporator is once again drawn into the compressor and the cycle starts anew. The action of compressing the vapor imparts work onto the vapor and results in a significant increase in the vapor temperature. While a substantial portion of this heat is subsequently rejected to the atmosphere during the condensation process, a portion of the heat is transferred to the compressor components. Depending upon the specific refrigerant vapor compressed and on the pressure conditions of operation, this heat transfer can cause the temperature of the compressor components to rise to levels which may cause the compressor to overheat, resulting in degradation of the compressor performance and lubrication and possible damage to the compressor.

In order to overcome overheating problems, various methods have been developed for injecting gaseous or liquid refrigerant under pressure into the suction inlet of a compressor where it expands and cools the inlet vapor and the compression chamber. Two such system are disclosed and described in detail in commonly assigned U.S. Pat. Nos. 5,076,067 and 4,974,427 the disclosures of which are hereby expressly incorporated herein by reference. However, injecting refrigerant into the inlet port of the compressor suffers the disadvantage that it reduces the compressor efficiency by reducing the net amount of refrigerant drawn into the compressor on the suction side of the refrigeration circuit. In order to minimize this reduction in efficiency, systems have been developed using thermostats or other thermal transducer circuits incorporating valve means to limit the injection of refrigerant to only those times when the compressor temperature rises to a certain preset temperature, such as occurring under abnormally high load situations. Other methods of controlling the amount of liquid injection include providing capillary tubes or thermal expansion valves. While these devices are simple and relatively low cost, they are known to leak excess refrigerant from the high pressure discharge side into the relatively low pressure suction side of the compressor, thus potentially increasing flooding problems.

Additionally, when the compressor is deactivated, high pressure refrigerant can further migrate through these devices to the normally low pressure inlet of the compressor, thus increasing the chance of starting problems.

Another known system reduces discharge temperature by injecting liquid refrigerant directly into the pumping chamber at an intermediate pressure point therein. The disadvantage of such a system is that it requires very accurate, repeatable and long life thermostatic devices, as well as reliable, long life control valves. Substantial extra machining is also required.

The present invention overcomes the aforesaid disadvantages of prior liquid injection systems by providing a system which is self-regulating and therefore eliminates the complexity introduced by thermostat control systems and which provide for the injection of liquid refrigerant into an existing chamber in many scroll machines which is always adjacent to and in fluid communication with an intermediate stage of the compressor; i.e. the intermediate axial biasing chamber for enhancing scroll tip sealing. In addition, a restriction is provided to reduce the pressure of the injected liquid to approximately that of the intermediate stage of the compressor. In this arrangement, the increase or decrease in pressure at the intermediate stage of the compressor in response to increase or decrease of suction pressure, and hence the pressure differential across the compressor, acts to automatically regulate the amount of liquid refrigerant injected, thus providing enough liquid to cool the compressor without causing flooding. Further, the present invention provides for an optional simple valve actuated in response to operation of the compressor to prevent migration of fluid into the compressor when it is not operating. The present invention also contemplates the use of bleed hole pairs (symmetrical or preferably non-symmetrical) for the injection of liquid refrigerant, without any type of intermediate pressure axial biasing. The term "liquid injection" is used herein to denote that it is liquid refrigerant which is taken from downstream of the condenser, but in reality a small portion of this liquid is vaporized as it flows to and into the compressor so that it is a two phase (liquid and vapor) fluid which is actually injected into the compressor. This is to be distinguished from vapor injection systems where pure vapor is taken from a heat exchanger or subcooler and is introduced into the compressor at an intermediate pressure.

Theoretically, there is no thermodynamic advantage (or penalty) to be derived from the use of liquid injection into an intermediate pressure-compression chamber for the purpose of discharge gas cooling. On the other hand, because a real system is not perfect in the theoretical sense, it has been observed that some heat transfer inefficiencies are in fact reduced in the compressor super heat process by the injection of liquid refrigerant, and as a consequence efficiency increases of 2 to 4 percent can be realized.

The present invention is uniquely adaptable to provide cooling by injecting liquid refrigerant into intermediate axial pressure biasing chambers on either the non-orbiting scroll side or the orbiting scroll side of the compressor, and/or through unequally located bleed holes.

Additional advantages and features or the present invention will become apparent from the subsequent description and the appended claims taken in conjunction with the accompanying drawings.

BRIEF DESCRIPTION OF THE DRAWINGS

FIG. 3 is a schematic diagram of a refrigeration system incorporating the principles of the present invention with injection occurring on the non-orbiting scroll side of the compressor;

DETAILED DESCRIPTION OF THE PREFERRED EMBODIMENTS

Figure 1:
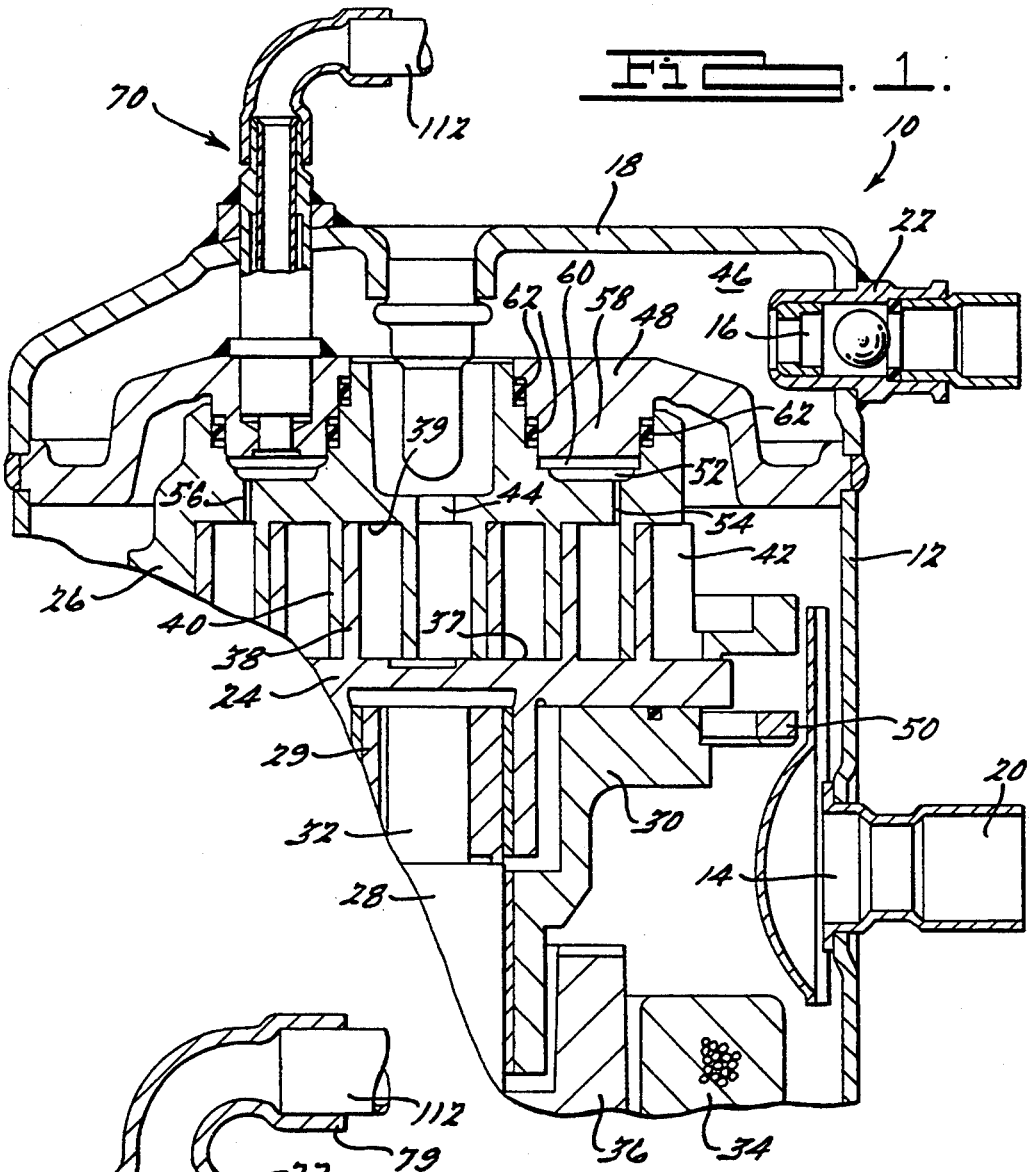
FIG. 1 is a fragmentary vertical sectional view of a compressor embodying the liquid injection system of the present invention wherein injection occurs on the non-orbiting scroll side of the compressor.

Referring now to the drawings and more particularly to FIG. 1, there is shown a hermetic refrigerant compressor 10 of the scroll type. Compressor 10 includes an outer hermetically sealed shell 12 which includes a suction inlet port 14 provided in a sidewall portion thereof and a discharge port 16 provided in a cover member 18 closing the upper end of shell 12. Suitable inlet and discharge fittings 20 and 22, respectively, are secured to respective ports 14 and 16 for connecting the compressor to a refrigeration system. The liquid injection assembly of the present invention is shown at 70, affixed to and extending through cover member 18.

A scroll-type compressor is disposed within shell 12 and includes orbiting and non-orbiting scroll members 24 and 26, respectively, a drive shaft 28 rotatably supported by a bearing housing 30, the drive shaft having an eccentric pin 32 at the upper end thereof coupled to orbiting scroll member 24 which operates to orbitally drive same in the usual manner through a bushing 29. A driving motor is disposed in a lower portion of shell 12 and includes a stator 34 supported by shell 12 and a rotor 36 carried by drive shaft 28. Scroll members 24 and 26 include end plates 37 and 39 from which extend interleaved spiral wraps 38 and 40, respectively, generally defined as the involute of a circle, which operate to define moving fluid pockets of changing volume as scroll member 24 orbits with respect to scroll member 26. A compressor suction inlet opening 42 is provided in non-orbiting scroll member 26 for admitting suction gas into the compressor and a central discharge passage 44 is provided which communicates with a discharge muffler chamber 46 defined between cover member 18 and partition member 48 extending over shell 12. An Oldham coupling 50 is also provided which operates in the usual manner to prevent relative rotation between scroll members 24 and 26.

Figure 6:
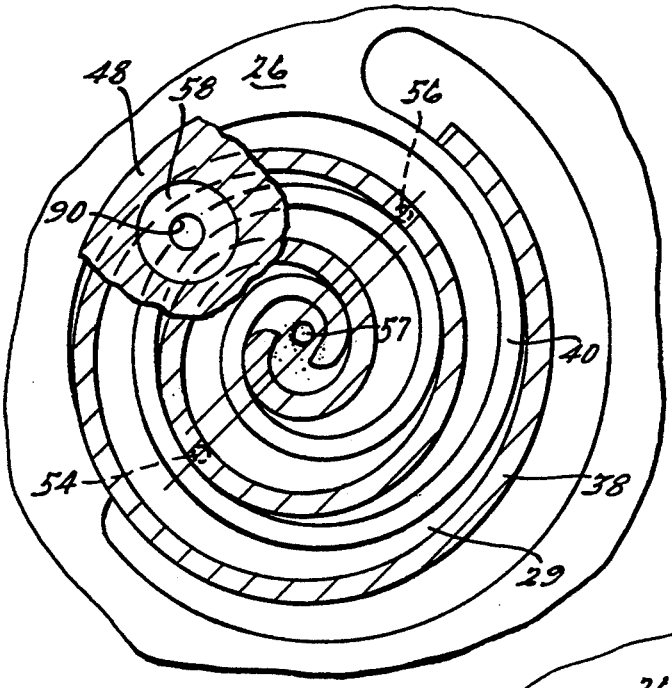
FIG. 6 is a partially cutaway fragmentary sectional view of the scroll members illustrating the preferred location of the bleed holes in the non-orbiting scroll member, in accordance with the present invention.

In this embodiment the scroll compressor 10 is of the type having intermediate pressure biasing of the non-orbiting scroll member 26 against the orbiting scroll member 24 for enhanced sealing. This arrangement, including the way the two scroll members are mounted, the Oldham coupling, and the compliant drive mechanism are described in detail in commonly assigned U.S. Pat. No. 4,877,382 the disclosure of which is hereby expressly incorporated herein by reference. As can be seen in FIG. 1, non-orbiting scroll member 26 has formed therein an annular depression 52. At the base of annular depression 52, in existing air conditioning compressors, there is formed a bleed hole 54 (FIG. 6) through end plate 39 adjacent the inner (concave) surface of wrap 40 providing fluid communication to an intermediate stage of compression in compressor 10. Partition member 48 is further shown having an annular projection 58 sealingly engaged with annular depression 52 thereby forming an intermediate biasing pressure chamber 60. Non-orbiting scroll member 26 is mounted for limited axial displacement relative to partition member 48 in the manner described in aforesaid U.S. Pat. No. 4,877,382. As will be appreciated, during the compression process, because intermediate biasing chamber 60 is always in fluid communication with the scroll compression chambers via hole 54, the pressure in chamber 60 time averages at an intermediate pressure, i.e., somewhere between suction pressure and discharge pressure. However, this pressure will slightly vary with the changes in pressure in the compression chambers to which it is connected by hole 54. Consequently, there will be an ebb and flow through hole 54 as the compressor goes through a full cycle. This pressure acts against annular projection 58 and annular depression 52 thus urging non-orbiting scroll member 40 against orbiting scroll member 38 to enhance axial tip sealing. A plurality of annular seals 62 are provided to prevent leakage of intermediate pressure into or out of exhaust chamber 46. Except for injection assembly 70, the apparatus heretofore described is known in the art or the subject matter of other patent applications owned by the assignee of this application.

Figure 9:
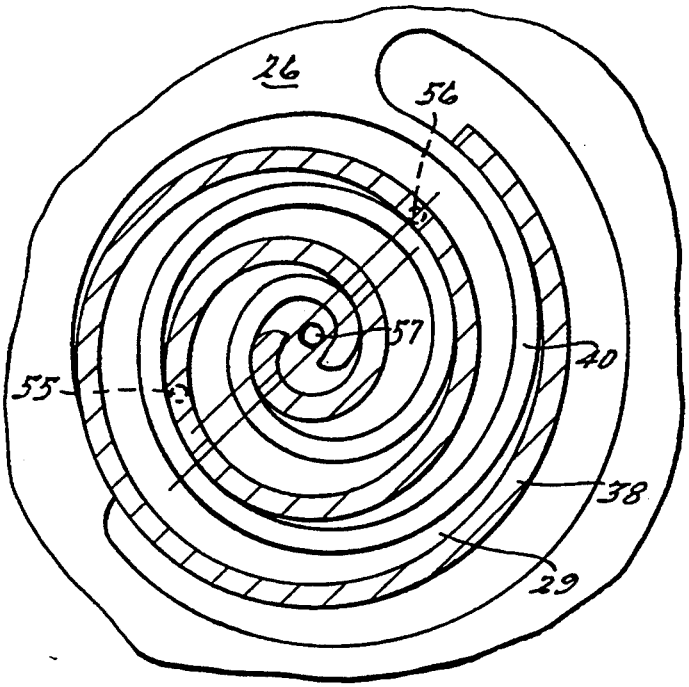
FIG. 9 is a view similar to that of FIG. 6 but showing an alternative location for one of the bleed holes.

Although the use of a single hole 54 is satisfactory for use in the liquid injection function of the present invention, it is preferable to provide two symmetrically located bleed holes 54 and 56 through end plate 39 in order to more evenly distribute the liquid in the intermediate compression chamber. Bleed holes 54 and 56 are symmetrical in that they are located on parallel lines which are tangent to the generating circle 57 of wrap 40, and hole 56 is located adjacent the outer (convex) surface of wrap 40. Alternatively, if it is desired to use a single bleed hole for liquid injection, then it is preferred to use hole 56 which is on the outer flank of the non-orbiting scroll wrap because this will provide more directional loading of the Oldham coupling. As a further alternative, if it is desired to use non-symmetrically located bleed holes, it is preferred that the bleed hole on the inner side of the non-orbiting scroll wrap be located slightly further from the suction inlet, such as at 55 in FIG. 9. In this arrangement the two bleed holes would then be 55 and 56. All bleed holes, in all embodiments, must be separated from the suction gas entry point by at least one wrap at all times.

Figure 2:
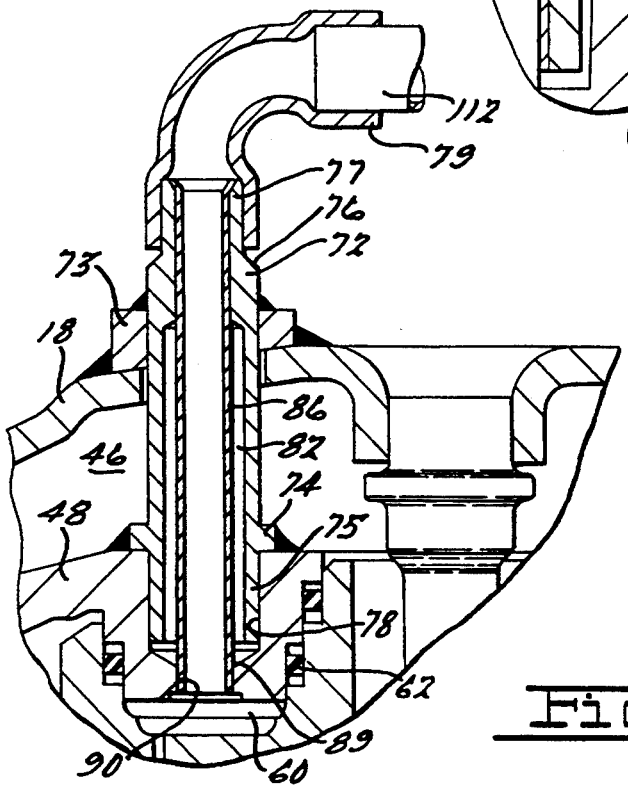
FIG. 2 is an enlargement of a portion of FIG. 1.
Figure 2:
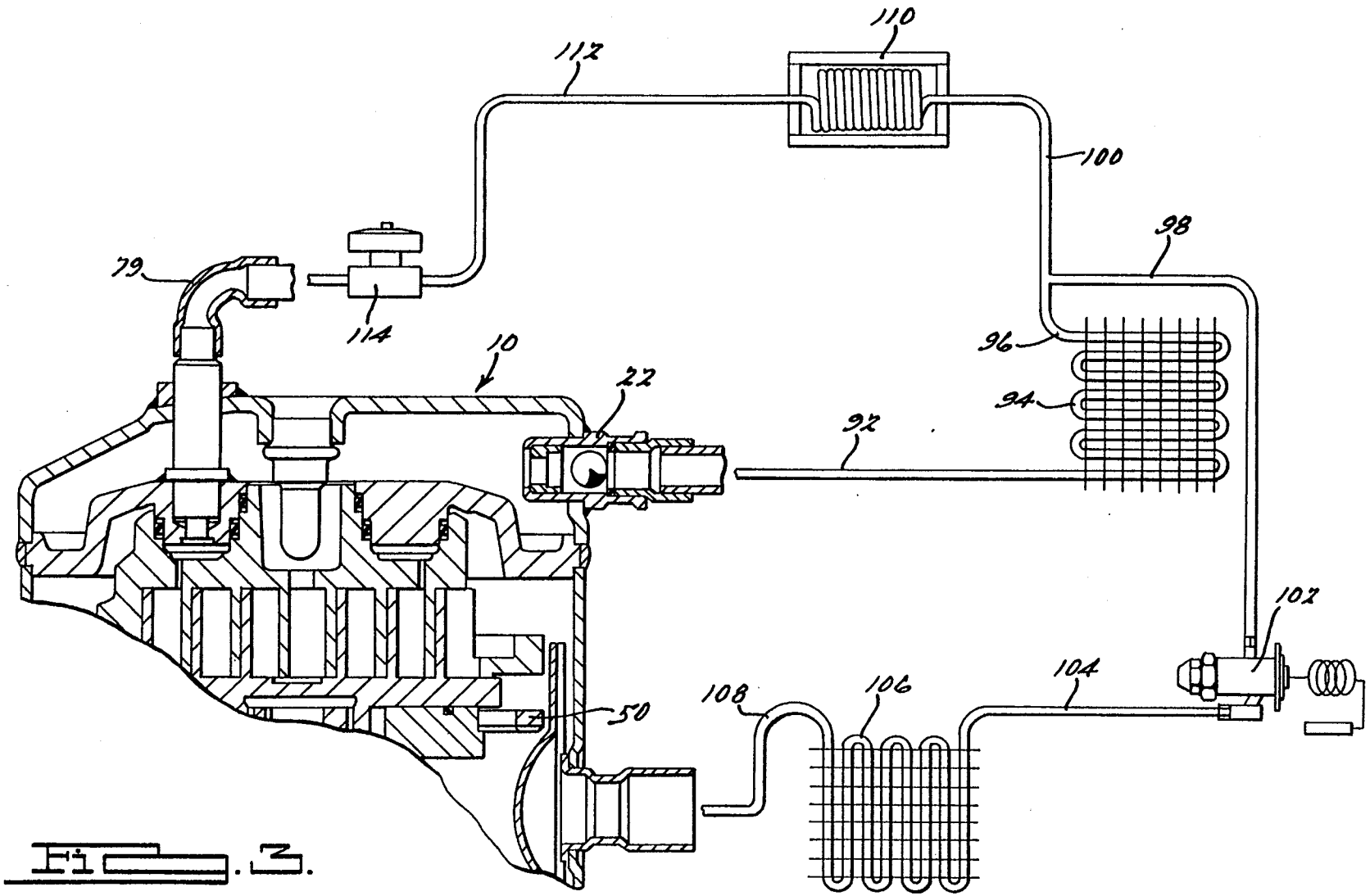

Now, with particular reference to FIG. 2, liquid injection assembly 70 comprises an outer substantially cylindrical tubular member 72 housing an integral shoulder portion 74 formed near its inner end 75 and a tapered portion 76 leading to its outer end 77 to a refrigerant line fitting 79. Inner end 75 is inserted into a close fit blind bore 78 formed in partition member 48 and shoulder 74 is welded to member 48 to form a leak-proof inner seal. The outer portion of member 72 is suitably secured by a welded collar 73 to cover member 18 to form a leak-proof seal. The inner diameter of member 72 is larger from the level of collar 73 downwardly to form a thermally insulating space 82 between it and an injection tube 86 disposed therein and press fit within the upper end of member 72. The injection tube 86 has its lower end 89 projecting into a bore 90 formed in partition 48 at the base of bore 78, thereby providing a fluid connection between injection assembly 70 and intermediate biasing chamber 60. As can best be seen in FIG. 2, space 82 acts to insulate injection tube 86 from the heated compressed refrigerant discharged through discharge passage 44 into muffler chamber 46. The insulation provided helps prevent the injected liquid from boiling off prior to injection into intermediate biasing chamber 60, which would reduce cooling efficiency. Preferably, the bulk of the refrigerant being injected into the intermediate compression chamber is still in the liquid phase. If a single bleed hole is used, injection tube 86 is preferably located radially and circumferentially so as to line up axially with the bleed hole. On the other hand, if a pair of bleed holes are used, then injection tube 86 is preferably located at a mid-point between the bleed holes so as to provide substantially equal flow to and through each.

The operation of the liquid injection system of the present invention may be best understood with reference to the refrigeration system schematic diagram shown in FIG. 3. Compressor 10 includes a gas discharge line 92 connected to discharge fitting 22 for supplying high pressure refrigerant to a condenser 94. A liquid conduit 96 extends from condenser 94 and branches into a normal flow line 98 and a liquid injection line 100. Completing the general operation of the refrigeration circuit, line 98 communicates condensed relatively high pressure liquid refrigerant to an expansion valve 102 where it is expanded into relatively low pressure liquid and vapor. Line 104 communicates the low pressure liquid and vapor to evaporator 106 where the liquid evaporates, thereby absorbing heat and providing the desired cooling effect. Finally, a return gas line 108 delivers the low pressure refrigerant vapor to the suction inlet of compressor 10.

In order to provide cooling to compressor 10, liquid injection line 100 acts to extract a portion of the relatively high pressure liquid refrigerant from the general refrigeration circuit. A restrictor 110 is provided to restrict the amount of liquid extracted to an amount adequate to cool the compressor under high load operation. In the preferred embodiment, restrictor 110 is a precalibrated capillary tube. It should be understood however, that restrictor 110 may also be a calibrated orifice or an adjustable screw type restriction. This extracted liquid is then communicated by a line 112 through a shut-off valve 114 to the liquid injector assembly 70 where the liquid is injected into compressor 10 to effect cooling. Valve 114 is actuated concurrent with compressor operation to allow fluid flow and closes upon compressor deactivation to prevent leakage of liquid refrigerant into the compressor which could cause flooding.

The manner in which cooling is effected will now be described. As is well known, in a scroll type compressor the vapor is drawn in at an inlet or suction pressure, whereupon it is increased in pressure to various intermediate pressures through action of the scrolls creating progressively smaller and smaller compression chambers, and finally it is discharged at a relatively high discharge pressure. In this arrangement, the intermediate pressure is generally a direct function of the suction pressure, and the discharge pressure is a function of ambient conditions. As the load on the refrigeration circuit increases the pressure differential across the compressor also increases. This in turn causes the pressure differential between the intermediate compression chamber and the condenser to increase thus increasing the flow of liquid refrigerant from the condenser to the compressor for cooling purposes. Likewise, as load decreases the overall pressure differential decreases, and the differential between the condenser and intermediate compressor chamber also decreases thus reducing liquid refrigerant flow to the compressor. These pressure changes, therefor, advantageously provide a means for self regulating the cooling of the compressor through liquid injection. As can be appreciated, restrictor 110 should be designed so that under high load conditions (i.e. at the worst anticipated temperature or pressure ratio conditions), the resistance of the restrictor 110 in combination with the resistance of the bleed hole(s) is such that a sufficient quantity of liquid will be injected to provide adequate compressor cooling. As the load drops the amount of liquid injected will drop because the overall pressure ratio will drop. The present invention thus provides a self regulating apparatus for automatically cooling a scroll type compressor which utilizes intermediate pressure axial biasing and/or uniquely located bleed holes.

It should be understood, however, that this system may also be adapted for control by a thermostat, or a variable orifice (in lieu of restrictor 110) which is responsive to discharge temperature, although the use of such controls would reduce some of the advantages of the present system.

Figure 4:
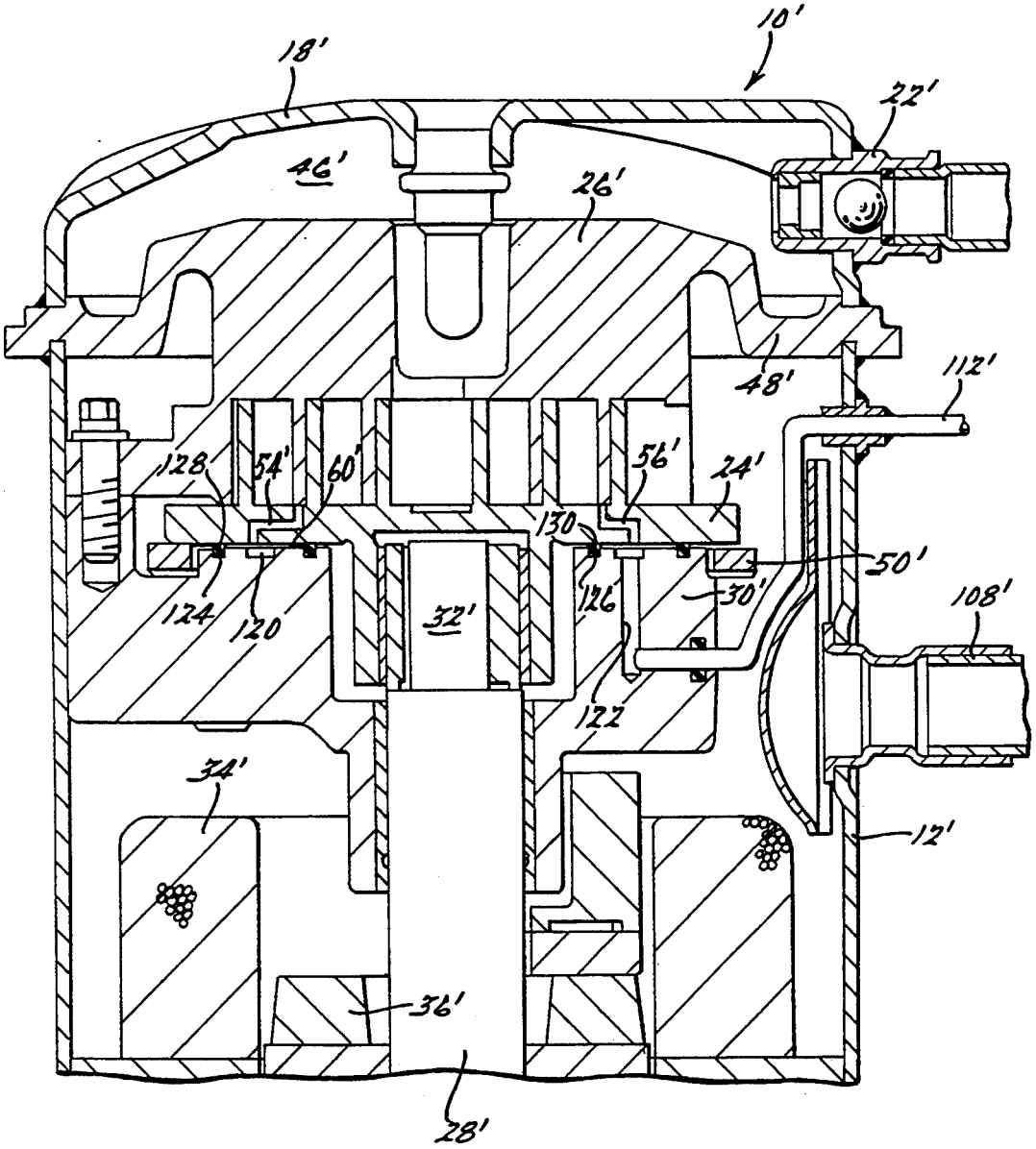
FIG. 4 is a view similar to FIG. 1, but illustrating the present invention wherein injection occurs on the orbiting scroll side of the compressor.
Figure 5:
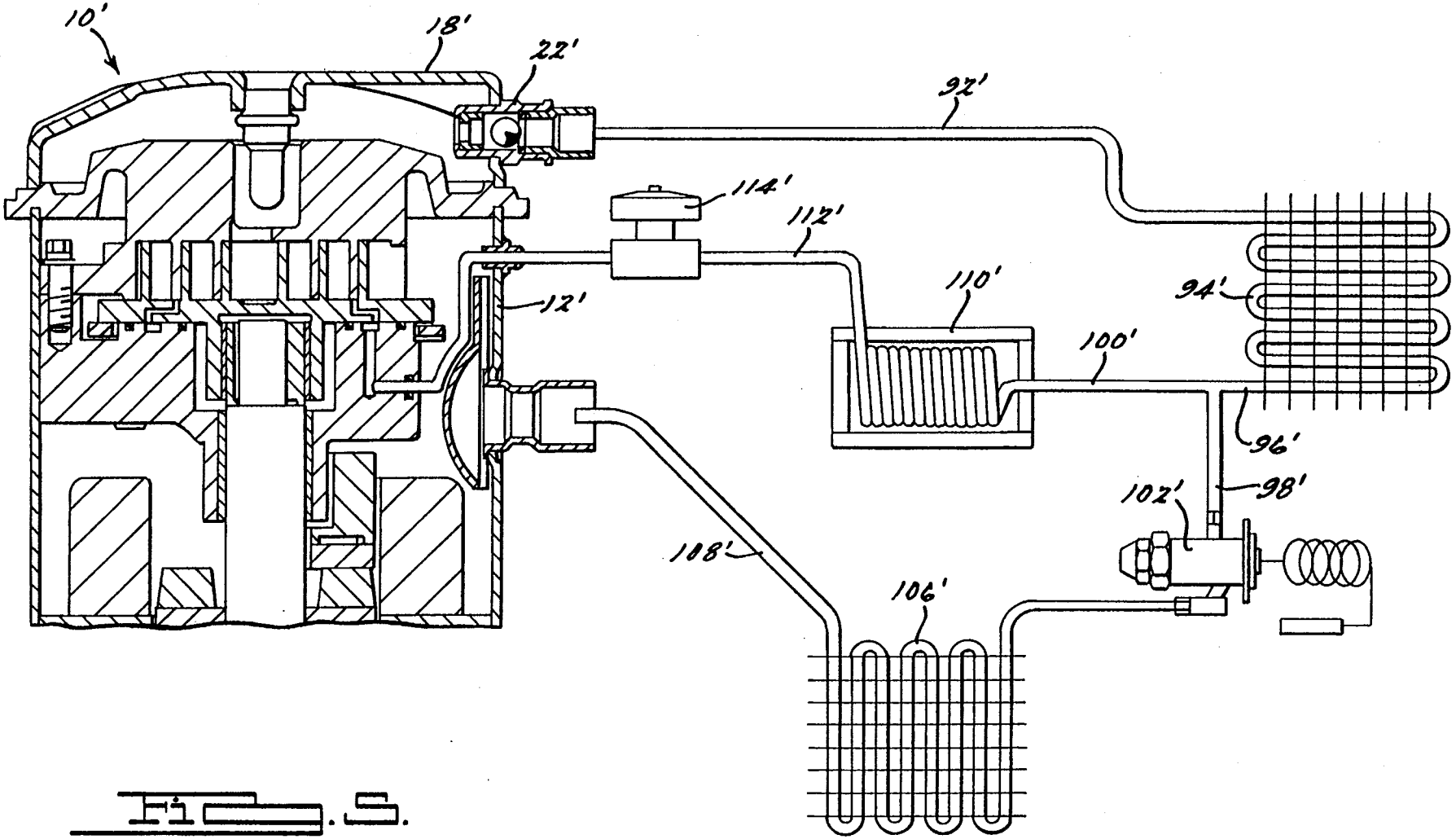
FIG. 5 is a view similar to FIG. 3, but illustrating the present invention with injection occurring on the orbiting scroll side of the compressor.
Figure 7:
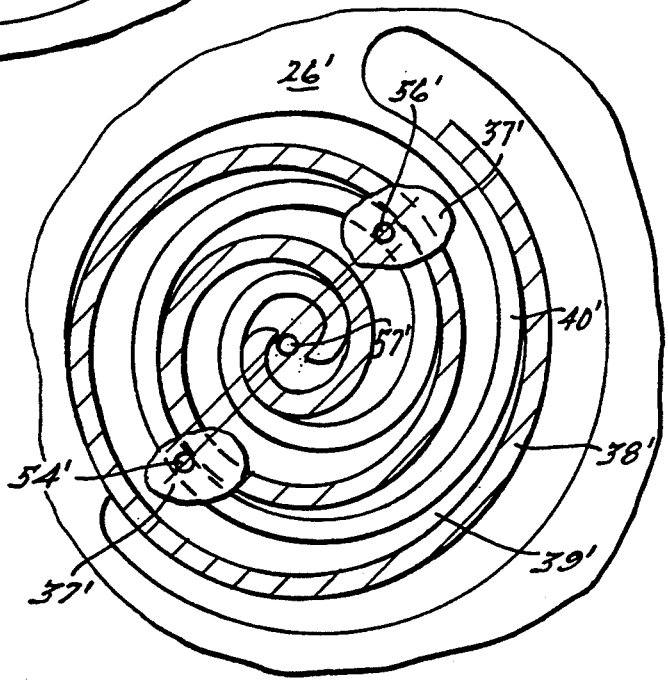
FIG. 7 is a view similar to FIG. 6 but showing the invention applied to the orbiting scroll member.
Figure 10:
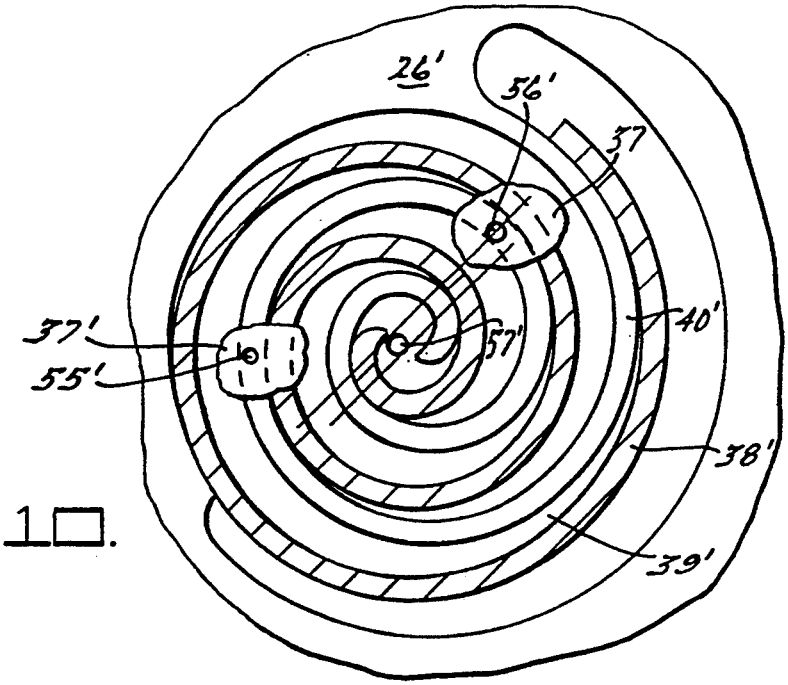
FIG. 10 is a view similar to that of FIG. 7 but showing an alternative location for one of the bleed holes applied to the orbiting scroll.

With reference to FIGS. 4 and 5, there are illustrated a compressor 10' and a schematic refrigeration circuit, respectively, of a second embodiment of the present invention wherein liquid refrigerant is injected on the orbiting side of compressor 10'(i.e. where it is the orbiting scroll member which is subject to axial biasing by intermediate pressure rather than the non-orbiting scroll member). Primed reference numbers are used to distinguish the parts of this embodiment which are the same as those in the first embodiment. As seen in FIG. 4, non-orbiting scroll member 26' is formed integral with partition member 48' to prevent axial movement thereof. As best seen in FIGS. 7 and 10, orbiting scroll member 24' has bleed holes 54', 55' and 56' formed therein in the same manner and for the same purpose as in the previous embodiments to provide fluid communication between an intermediate stage of compressor 10' and the upper surface of bearing housing 30', which has formed therein an annular groove 120 communicating with an axial bore 122, which in turn is suitably connected to the liquid injection line 112' to communicate liquid refrigerant to an intermediate compression chamber. An intermediate axial biasing chamber 60' is defined between annular grooves 124 and 126 into which annular seals 128 and 130, respectively, are disposed to prevent leakage of intermediate pressure fluid into compressor shell 12'. Fluid at intermediate pressure in chamber 60' via bleed holes 54' and 56' acts between the upper surface of bearing housing 30' and the lower surface of scroll member 24' to axially bias the latter against non-orbiting scroll member 26' to enhance wrap tip sealing.

Bleed holes 54', 55' and 56' are through the orbiting scroll member end plate 37' in equivalent positions to the bleed holes in the first embodiment, except that now hole 54' is adjacent the outside (convex) surface of wrap 38' and hole 56' is adjacent the inner (concave) surface of wrap 38', with hole 55' being slightly further from the suction area than hole 54'. The preferable choice is bleed holes 54' and 56' which are symmetrical in that they are located on parallel lines which are tangent to the generating circle 57' of wrap 38'. Alternatively, if it is desired to use a single bleed hole for liquid injection purposes, then it is preferred to use hole 56' because this will provide more directional loading of the Oldham coupling. As a further alternative, if it is desired to use non-symmetrically located bleed holes it is preferred that the bleed hole on the outer side of the orbiting scroll wrap be located slightly further from the suction inlet, such as at 55' in FIG. 10. As before, all bleed holes, in all embodiments, must be separated from the suction gas entry point by at least one wrap at all times.

As shown in FIG. 5, discharge vapor is delivered to condenser 94' via conduit 92'. A portion of the high pressure liquid exiting condenser 94' is then extracted from the refrigeration circuit, the amount of which is controlled by restrictor 110'. This extracted portion of liquid is then communicated through shut-off valve 114' to compressor 10' via conduit 112' suitably connected in the manner shown to bore 122' formed in bearing housing 30'. This arrangement advantageously provides self regulating cooling for a scroll type compressor, functioning in exactly the same manner as the first embodiment. The same optional control methods also apply to this embodiment.

Figure 8:
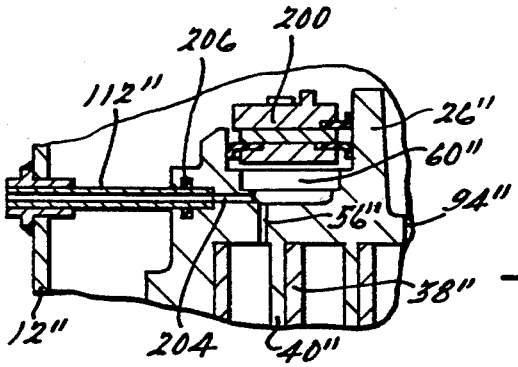
FIG. 8 is an enlarged fragmentary sectional view of a further embodiment of the present invention.

In the embodiment of FIG. 8, all the principles of operation are the same with only difference being that the intermediate pressure axial biasing chamber 60'' is partially defined by a floating seal 200 disposed therein. This construction is fully described and shown in applicant's co-pending application Ser. No. 07/841,251, filed Feb. 24, 1992, now U.S. Pat. No. 5,156,539, the disclosure of which is hereby incorporated herein by reference. Because of the existence of floating seal 200, it is not possible to use an injector assembly such as described in connection with the preceding first embodiments. Consequently, in this embodiment liquid refrigerant is brought back to chamber 60'' by means of liquid line 112'' which extends through a suitable fitting 202 in shell 12'' and thence into a passageway 204 which communicates with chamber 60''. Although non-orbiting scroll 26'' moves very slightly in an axial direction, fluid line 112'' is sufficiently flexible to accommodate such movement. If desired, a suitable seal 206 may be provided between the non-orbiting scroll member and fluid line 112''. In all other respects, this embodiment functions in exactly the same manner as in the first embodiment described herein.

While it is apparent that the preferred embodiments of the invention disclosed are well calculated to provide the advantages and features above stated, it will be appreciated that the invention is susceptible to modification, variation, and change without departing from the proper scope or fair meaning of the subjoined claims.

We claim:

1. A scroll compressor comprising:

first and second scroll members each having an end plate on one face of which is disposed a scroll wrap, said scroll defined by a generating circle members being mounted so that said wraps are intermeshing with respect to one another so that when said first scroll member moves in an orbital path with respect to said second scroll member, said wraps define moving fluid compression chambers which progress from a relatively large size at suction pressure to a relatively small size at discharge pressure;

a first bleed hole extending through the end plate of one of said scroll members, said first bleed hole placing a first intermediate chamber in communication with a source of refrigerant at a pressure;

a second bleed hole extending thorough the end plate of said one of said scroll members, said first and second bleed holes being located non-symmetrically, that is, said holes being located on non-parallel lines tangent to said generating circle of said wrap, said second bleed hole placing a second intermediate chamber in communication with said source of refrigerant at said pressure.

2. A scroll compressor as claimed in claim 1 wherein said one of said scroll members is an orbiting scroll.

3. The scroll compressor as claimed in claim 2 wherein said first bleed hole is located adjacent the inner surface of said scroll wrap and said second bleed hole is located adjacent the outer surface of said scroll wrap slightly further from the suction inlet of said compressor than if said second bleed hole was located symmetrically.

4. A scroll compressor as claimed in claim 1 wherein said one of said scroll members is a non-orbiting scroll.

5. A scroll compressor as claimed in claim 4 wherein said first bleed hole is located adjacent the outer surface of said scroll wrap and said second bleed hole is located adjacent the inner surface of said scroll wrap slightly further from the suction inlet of said compressor than if said bleed hole was located symmetrically.

6. The scroll compressor as claimed in claim 1 wherein said pressure is intermediate said suction pressure and said discharge pressure.

7. A scroll compressor as claimed in claim 1 wherein, said refrigerant is liquid refrigerant.

8. A scroll compressor comprising:

first and second scroll members each having an end plate on one face of which is disposed a scroll wrap defined by a generating circle, said scroll members being mounted so that said wraps are intermeshing with respect to one another so that when said first scroll member moves in an orbital path with respect to said second scroll member, said wraps define moving fluid compression chambers which progress from a relatively large size at suction pressure to a relatively small size at discharge pressure;

a first bleed hole extending through the end plate of one of said scroll members, said first bleed hole placing a first intermediate chamber defined by said wraps in communication with a fluid biasing chamber, fluid within said biasing chamber urging said one scroll member towards the other of said scroll members; and a second bleed hole extending thorough the end plate of said one of said scroll members, said first and second bleed holes being located non-symmetrically, that is, said holes being located on non-parallel lines tangent to said generating circle of said wrap, said second bleed hole placing a second intermediate chamber defined by said wraps in communication with said fluid biasing chamber.

9. A scroll compressor as claimed in claim 8 wherein, said fluid biasing chamber is in communication with a source of refrigerant at a pressure.

10. A scroll compressor as claimed in claim 9 wherein, said refrigerant is liquid refrigerant.

11. A scroll compressor as claimed in claim 8 wherein said one of said scroll members is an orbiting scroll.

12. The scroll compressor as claimed in claim 11 wherein said first bleed hole is located adjacent the inner surface of said scroll wrap and said second bleed hole is located adjacent the outer surface of said scroll wrap slightly further from the suction inlet of said compressor than if said second bleed hole was located symmetrically.

13. A scroll compressor as claimed in claim 8 wherein said one of said scroll members is a non-orbiting scroll.

14. A scroll compressor as claimed in claim 8 wherein said first bleed hole is located adjacent the outer surface of said scroll wrap and said second bleed hole is located adjacent the inner surface of said scroll wrap slightly further from the suction inlet of said compressor than if said bleed hole was located symmetrically.

* * * * *

UNITED STATES PATENT AND TRADEMARK OFFICE

CERTIFICATE OF CORRECTION

PATENT NO. : 5,447,420

DATED : September 5, 1995

INVENTOR(S) : Jean-Luc Caillat; Karl P. Wang

It is certified that error appears in the above-indentified patent and that said Letters Patent is hereby corrected as shown below:

Column 1, line 24, delete "15".

Column 1, line 47, "system" should be — systems —.

Column 2, line 65, "or" should be — of —.

Column 6, line 22, "therefor" should be — therefore —.

Column 8, line 7, after "wrap" insert — defined by a generating circle —.

Column 8, line 7, after "scroll" delete — defined by a generating circle —

Column 8, line 20, "thorough" should be — through —.

Column 9, line 1, "thorough" should be — through —.

Column 10, line 10, "8" should be — 13 —.

Signed and Sealed this

Ninth Day of April, 1996

Bruce Lehman

*Attest:*

BRUCE LEHMAN

*Attesting Officer*

*Commissioner of Patents and Trademarks*